US005742308A

United States Patent [19]

Cowger et al.

[11] Patent Number: 5,742,308

[45] Date of Patent: Apr. 21, 1998

[54] INK JET PRINTER CARTRIDGE REFILLING METHOD AND APPARATUS

[75] Inventors: Bruce Cowger; Robert R. Beeson; Fred E. Tarver, all of Corvallis, Oreg.

[73] Assignee: Hewlett-Packard Company, Palo Alto, Calif.

[21] Appl. No.: 220,767

[22] Filed: Mar. 30, 1994

[51] Int. Cl.[6] ..... B41J 2/175; B41J 2/195

[52] U.S. Cl. ..... 347/85; 347/7

[58] Field of Search ..... 347/7, 85, 86, 347/87

[56] References Cited

U.S. PATENT DOCUMENTS

| | | | |
|---|---|---|---|
| 4,121,222 | 10/1978 | Diebold et al. . | |
| 4,178,595 | 12/1979 | Jinnai et al. | 347/7 |
| 4,187,511 | 2/1980 | Robinson | 347/7 |
| 4,234,885 | 11/1980 | Arway . | |
| 4,518,973 | 5/1985 | Tazaki . | |
| 4,940,997 | 7/1990 | Hamlin et al. . | |
| 4,967,207 | 10/1990 | Ruder | 347/7 |
| 4,977,413 | 12/1990 | Yamanaka et al. | 347/7 |
| 5,136,305 | 8/1992 | Ims | 347/7 |
| 5,187,498 | 2/1993 | Burger | 347/86 |
| 5,280,299 | 1/1994 | Saikawa et al. | 347/87 |
| 5,289,211 | 2/1994 | Moranclotti et al. | 347/7 |

FOREIGN PATENT DOCUMENTS

| | | | |
|---|---|---|---|
| 419 876 A1 | 8/1990 | European Pat. Off. . | |
| 536 980 A2 | 4/1993 | European Pat. Off. . | |
| 611656-A2 | 8/1994 | European Pat. Off. | 347/86 |
| 59-179120 | 7/1986 | Japan . | |
| 6-40043 | 2/1994 | Japan . | |
| WO86/06032 | 10/1986 | WIPO . | |
| WO92/20577 | 11/1992 | WIPO . | |

*Primary Examiner*—Benjamin R. Fuller
*Assistant Examiner*—Judy Nguyen

[57] ABSTRACT

An ink jet printer having a travelling ink jet pen with a foam-filled ink chamber. A separate source reservoir includes an ink outlet nozzle connectable to the pen chamber for refilling. A probe on the reservoir partially compresses the foam to decrease its ink capacity during filling. An electrical contact on the reservoir or pen detects over-filling and over-saturation of the foam to stop the filling process. As the foam is decompressed, its increased absorptive capacity accommodates any excess overflow.

8 Claims, 3 Drawing Sheets

INK JET PRINTER CARTRIDGE REFILLING METHOD AND APPARATUS

TECHNICAL FIELD

This invention relates to ink jet printers, and more particularly to a printer wherein the ink reservoir on a travelling ink jet cartridge or pen may be refilled during normal operation.

BACKGROUND AND SUMMARY OF THE INVENTION

Ink jet printers normally employ ink jet cartridges or "pens" each having a print head and an integral reservoir that is not intended to be refilled. The pen is moved through a path over a sheet of paper for printing. When the reservoir is depleted, the entire pen must be replaced.

Automatically refillable ink pens have been proposed, but the existing designs have proven too complex or unworkable for use on low cost ink jet printers. To avoid leakage during filling, a sealable connection or connections may be required. This can be difficult to attain, particularly if multiple connections are employed. Furthermore, the seals may degrade over time or become fouled with debris.

To avoid overfilling the pen, systems may include internal level sensors that stop the refilling action when actuated. These are susceptible to false readings as the pen moves.

A major concern with overfilling is that an overfilled pen lacks the reduced internal pressure needed to retain ink and avoid ink "drool" from the print head orifices as ambient or internal pressure varies. A block of hydrophilic open-cell foam within the pen reservoir generates a capillary action that prevents ink from drooling from the print head orifices. Such foam, however, makes it difficult to detect whether the pen is overfilled.

Accordingly, there is a need for an apparatus and method for refilling a travelling ink reservoir on an ink jet pen that 1) maintains back-pressure to prevent drool from the pen, 2) avoids the need to form a seal during refilling, and 3) includes means to avoid over-filling the travelling reservoir. These and other needs are fulfilled by providing a travelling reservoir occupied by hydrophilic foam, and providing a compression element for selectively compressing the foam during refilling of the travelling reservoir to reduce the ink capacity of the foam. An ink nozzle emits ink from a primary stationary reservoir onto the foam. When the compressed foam becomes saturated, excess overflowing ink is detected by an adjacent sensor to signal stoppage of the refilling operation. As the compression element is withdrawn from the foam, the foam's ink capacity increases, causing it to absorb the excess ink, and to return to an under-saturated state to preserve ink back-pressure and prevent drool.

The foregoing and additional features and advantages of the present invention will be more readily apparent from the following detailed description which proceeds with reference to the accompanying drawings.

DETAILED DESCRIPTION OF A PREFERRED EMBODIMENT

Figure 1:
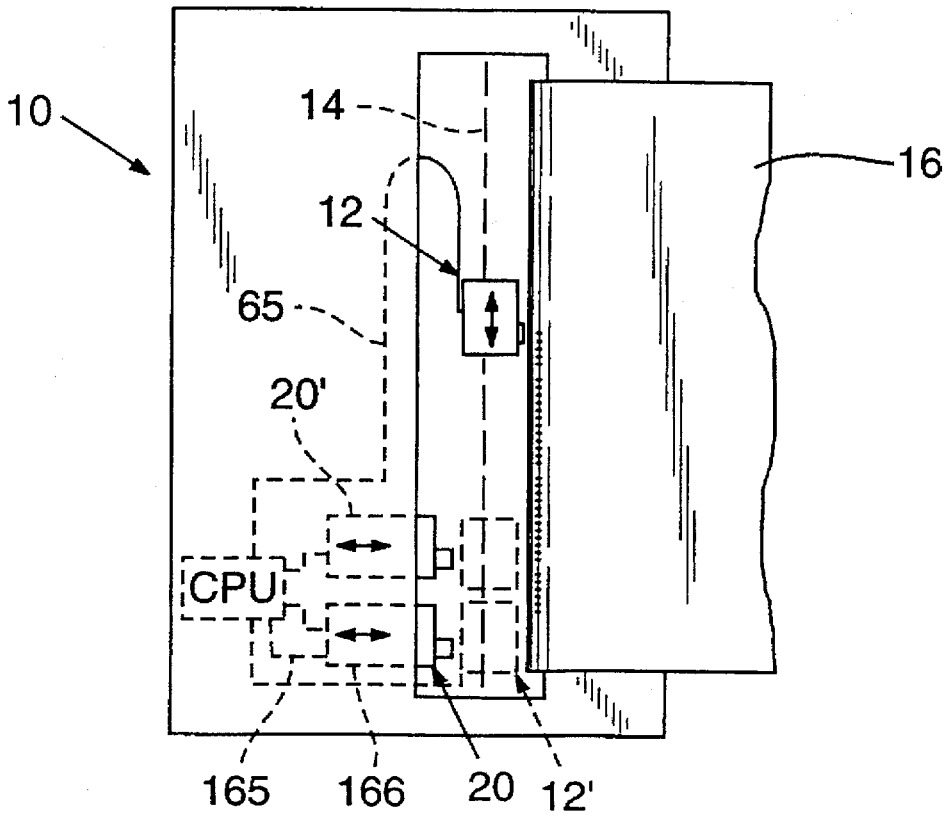
FIG. 1 is a schematic top view of an ink jet printer according to the present invention.

FIG. 1 shows a printer 10 having an ink jet cartridge or pen 12 mounted for movement along a linear path 14 adjacent a sheet of print media 16 such as paper. Because the pen 12 is not continuously connected to an external supply of ink and carries only a limited supply of ink as will be discussed below, periodic refilling is required. At least one ink reservoir 20 is positioned near the pen path 14 at a position registered with a pen refilling position 12'. The reservoir 20 may be fixed to the printer, or mounted for movement toward and away from the refilling position 12' in a direction perpendicular to the pen path 14 to couple with the pen. Alternatively, the reservoir may transmit ink to the pen over a gap, or by movement of the pen, a conduit or other ink transmission means to create a controlled ink flow between the reservoir and the pen. Additional reservoirs 20' may be included for supplying different color inks to the pen at different positions along the pen path. Color printers will normally include four cartridges containing cyan, yellow, magenta and black ink, respectively. A printer central processing unit (CPU) is electrically connected to the pen 12 and to the reservoir(s) 20 for sensing and controlling refill and printing functions as discussed below.

Figure 2A:
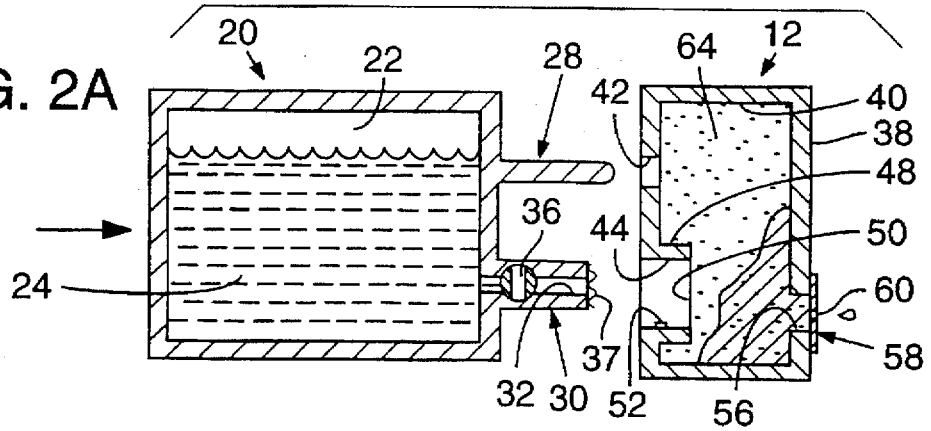
FIGS. 2A–2D are schematic cross-sectional views of an ink reservoir and pen of the embodiment of FIG. 1 in various stages of refilling the pen.
Figure 2B:
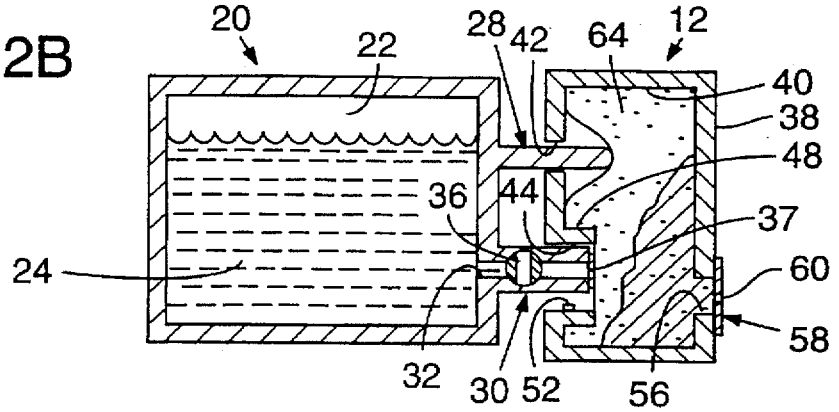
Figure 2C:
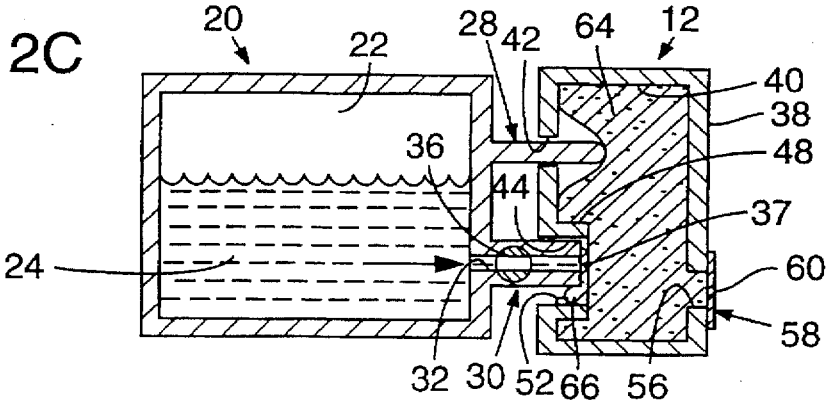

FIGS. 2A–2D schematically illustrate the refilling operation. FIG. 2A shows coupling; FIG. 2B, compression; FIG. 2C, ink filling; and FIG. 2D, decoupling. As shown in FIG. 2A, the reservoir 20 defines an enclosed chamber 22 at least partially filled with liquid ink 24 that is under pressure. A rigid probe or compression element 28 protrudes from one side of the reservoir toward the pen 12. A nozzle 30 defining an outlet passage 32 protrudes in a similar direction, with the outlet passage providing fluid communication between the chamber and the external region beyond the free end of the nozzle. A selectably closable valve 36 is serially included in the passage and has an open position (as shown in FIG. 2C) permitting fluid flow, and a closed position (as shown in FIG. 2A). Although not shown in FIG. 2A, the reservoir includes means for forcing the ink out of the nozzle. This may include a spring, solenoid, or other actuator to compress the reservoir or an ink-filled bag within the reservoir, as well as pneumatic or hydraulic actuators, gravity, a pump, or any other means for expelling fluid from the chamber.

The reservoir's outlet passage is covered at its free end by an attached fine-mesh screen 37. The screen is sufficiently fine to block passage of air bubbles when wet.

The pen 12 includes a housing 38 defining a small pen chamber 40. The housing 38 further defines a compression aperture 42 registrable with the reservoir's compression element 28 and having a diameter slightly larger than the largest diameter of the compression element so that the compression element may freely enter. The housing 38 further defines an inlet aperture 44 registrable with the nozzle 30 of the reservoir, and having a diameter slightly larger than that of the nozzle to permit its entry. A pair of electrical contacts 52 are attached within the inlet aperture 44 and are electrically connected to the printer CPU so that the resistance between the contacts may be measured to detect whether fluid is bridging the contacts.

The housing further defines an outlet aperture 56 providing ink flow to an attached print head 58 defining an array of orifices 60 through which ink is ejected onto the paper 16. The print head includes a number of selectively fired resistors, each of which may vaporize a quantity of ink to eject a droplet from an orifice. The contacts 52 and print head 58 are electrically connected to the CPU by a flexible printed circuit connection 65 shown in FIG. 1. The CPU keeps track of the number of ink drops printed until the number exceeds a predetermined value, upon which the refilling operation commences. The predetermined quantity is calculated to allow a safety margin of ink within the pen 12, to account for the uncertainties of ink usage and droplet size, evaporation, and to permit printing of the remainder of a given page to be completed.

The pen chamber 40 is occupied by a block of open-cell hydrophilic foam 64 which is shown occupying the entirety of the chamber 40, but which need only occupy a portion of the chamber, as long as it contacts the screen 50. Preferably, the foam occupies a large portion of the chamber volume to maximize the ink capacity of the chamber. The foam may be unsaturated (shown without hatching) or saturated (shown with hatching). Because of the capillarity of the small spaces within the foam, a limited quantity of aqueous ink will tend to aggregate in a single contiguous region. Consequently, all of the air previously in that region will be displaced, and that region will become saturated.

As shown in FIG. 2A, the ink-saturated portion within the pen 12 has diminished to a limited volume after printing the selected number of droplets. At this time, the CPU initiates refilling operations. The reservoir 20 is moved toward the pen 12 until it reaches the inserted position shown in FIG. 2B. In the inserted position, the compression element 28 penetrates the compression aperture 42 and impinges upon the foam 64. Consequently, the volume of the foam is decreased, reducing its ink capacity. During insertion, the valve 36 remains closed. In the fully inserted position shown in 2B, the free end of the nozzle 30 touches or is closely spaced apart from the screen 50, and remains spaced apart from the contacts 52. The reservoir is now in position for ink flow to commence.

As shown in FIG. 2C, the valve 36 is switched to the open position shown, permitting ink to flow through the nozzle onto the screen, whereupon the capillarity of the foam draws up the ink until it reaches the entirely saturated state shown. After the foam is saturated, ink flow continues until an overflow droplet 66 grows large enough within the inlet aperture 44 to touch both contacts 52, generating a shut-off signal as through the electrical circuit connections shown as 165, 166 in FIG. 1. The presence of excess ink in addition to that contained by the fully saturated foam is considered to define an over-saturated state. Thereupon, the printer control system associated with the CPU responds to the bridging of the contacts by causing the valve 36 to close, stemming the ink flow.

To avoid the possibility that a momentary splash or an excess flow rate may cause a premature shut-off signal from the contacts, the CPU may pause refilling operations briefly after the first shut-off signal is detected. If the foam in the chamber is not yet entirely saturated, the foam will draw in the overflow, so that the contact may be unbridged. Then, the pen 12 may be "topped off" with additional ink flow until an overflow droplet again reaches the contact 52. This process may be repeated as necessary.

Figure 2D:
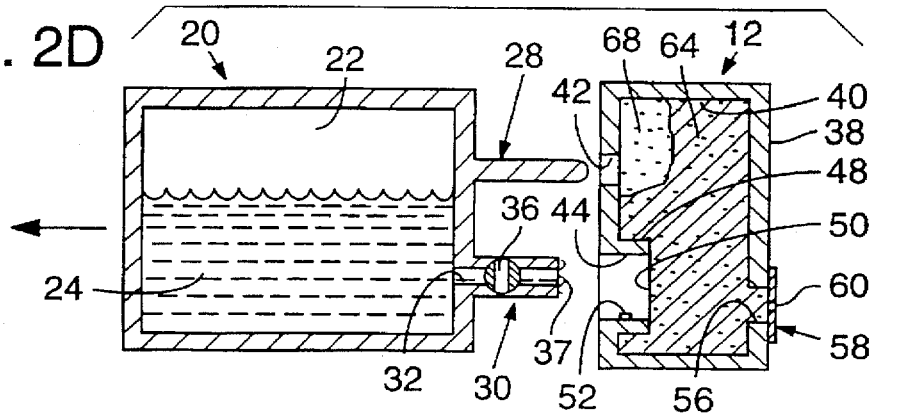

As shown in FIG. 2D, the reservoir 20 is withdrawn, with the compression element 28 releasing the foam 64, permitting the foam to reexpand to its original size. Reexpanded, the foam has an increased ink capacity compared to the compressed state shown in FIGS. 2B and 2C. This increase in capacity is more than adequate to reabsorb the overflow droplet 66, and to create a small unsaturated region 68, giving the refilled pen 12 excellent ink retention characteristics to prevent ink from drooling from any apertures.

Figure 3:
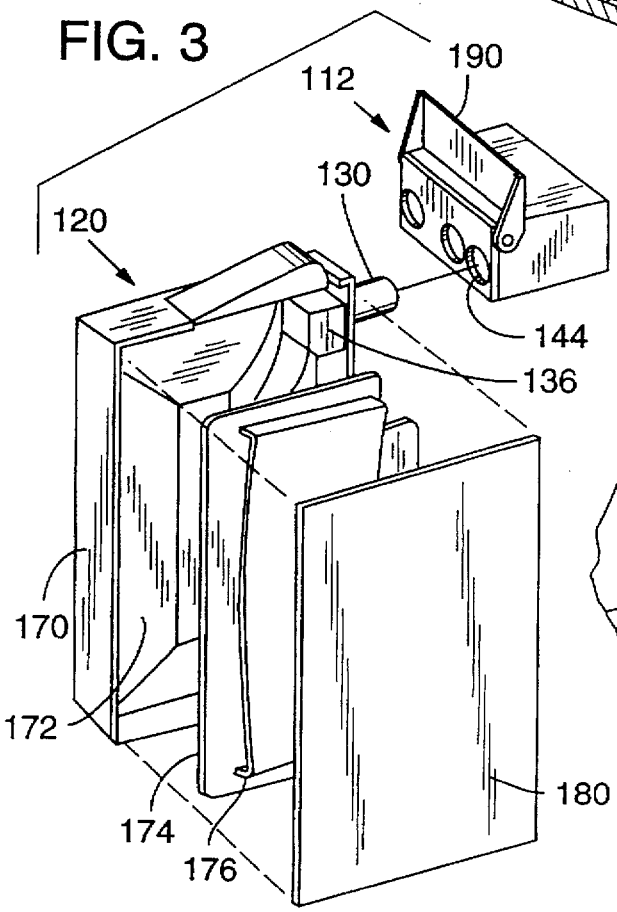
FIG. 3 is an exploded isometric view of a preferred embodiment of the invention.

FIG. 3 shows an embodiment in which a pen 112 may contain several colors of ink. A reservoir 120 contains one ink color; several others (not shown) contain different colored inks. The reservoir uses a spring pressurized ink bag to maintain positive pressure to emit ink into the pen 112 during refilling. The reservoir includes a housing 170 that contains a flexible ink-filled bag 172 that is open only to an outlet passage 132 shown in FIG. 4. As further shown in FIG. 3, a pressure plate 174 is generally coextensive with the bag for transmitting force to the entire area of the bag. A leaf spring 176 is held against the pressure plate 174 by a lid 180, which is secured to the housing 170. As a result, the ink bag may be filled with ink to occupy substantially the entire volume of the housing 170 at the outset, and is compressible essentially flat to efficiently emit nearly all ink contained within the reservoir.

Figure 4:
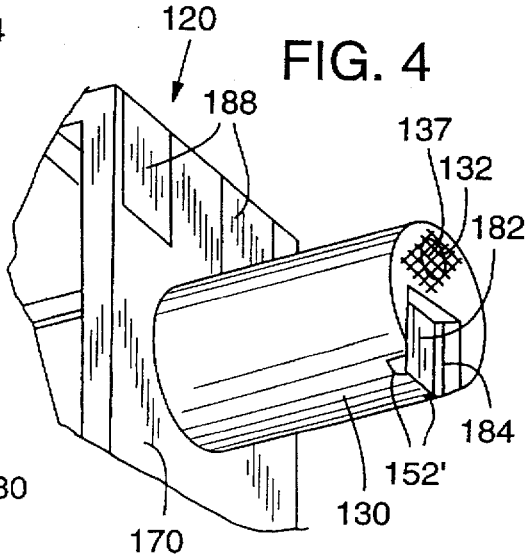
FIG. 4 is an enlarged fragmentary view of the ink reservoir nozzle of the embodiment of FIG. 3.

FIG. 4 shows the outlet nozzle 130 of the embodiment of FIG. 3. The nozzle is a cylindrical protrusion that mates with the inlet aperture 144 of the pen 112, similar to aperture 44 as discussed above with respect to FIGS. 2A–2D. The outlet passage 132, covered by screen 137, passes through the end of the nozzle, which includes contacts 152' for detecting excess ink during refill operations. The contacts are positioned below a recessed pocket 182, and may include contact portions 184 that extend upward into the pocket to detect excess moisture at the end face of the nozzle. A pair of printer interface contacts 188 is positioned on the exterior of the housing 170 near the nozzle, for electrical connection to the printer CPU when installed. The interface contacts 188 are electrically connected to the ink sensor contacts 152'.

The embodiment of FIGS. 3 and 4 does not include a separate compression element 28. The nozzle 130 itself serves a dual purpose of compressing the foam, and of transmitting the ink. In this embodiment, the pen 112 does not include a screen, because the nozzle must be able to compressively probe into the foam. To avoid false positive signals from the overflow contacts 152', the contacts are positioned slightly away from the end of the nozzle, and the contact portions 184 are recessed within the pocket 182 so that they are not activated by unsaturated foam.

The pen 112 further includes a protective shutter 190 as shown in FIG. 3. The shutter may be moved to the illustrated open position for refilling, or pivoted to a closed position in which the apertures 144 are covered to prevent evaporation and contamination of the pen's ink chamber. Such a shutter is also preferably included, although not illustrated, on the other embodiments discussed herein. A shutter may also be provided on the nozzle as well, to prevent evaporation from, and contamination of, the reservoir's ink supply.

Figure 5:
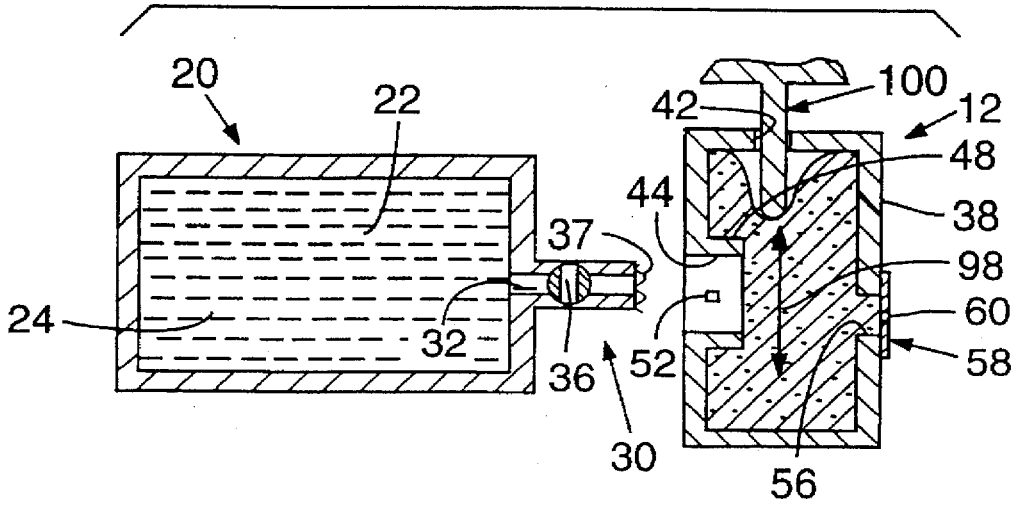
FIG. 5 is a schematic lateral cross-sectional view of the ink reservoir and pen of an alternative embodiment.

FIG. 5 shows an alternative embodiment in which the pen 12 defines a compression aperture 42 passing through an external wall perpendicular to the pen's normal direction of motion 98. A compression element 100 is mounted to a fixed portion of the printer in registration with the aperture 42 so that the foam is automatically compressed as the pen moves to the illustrated position for refilling. This alternative embodiment may be used to minimize moving parts. In an embodiment in which the reservoir outlet nozzle sprays ink onto the foam from a distance, there would be no need to move the reservoir relative to the pen or printer, and the pen would need only move along its normal printer path.

Figure 6:
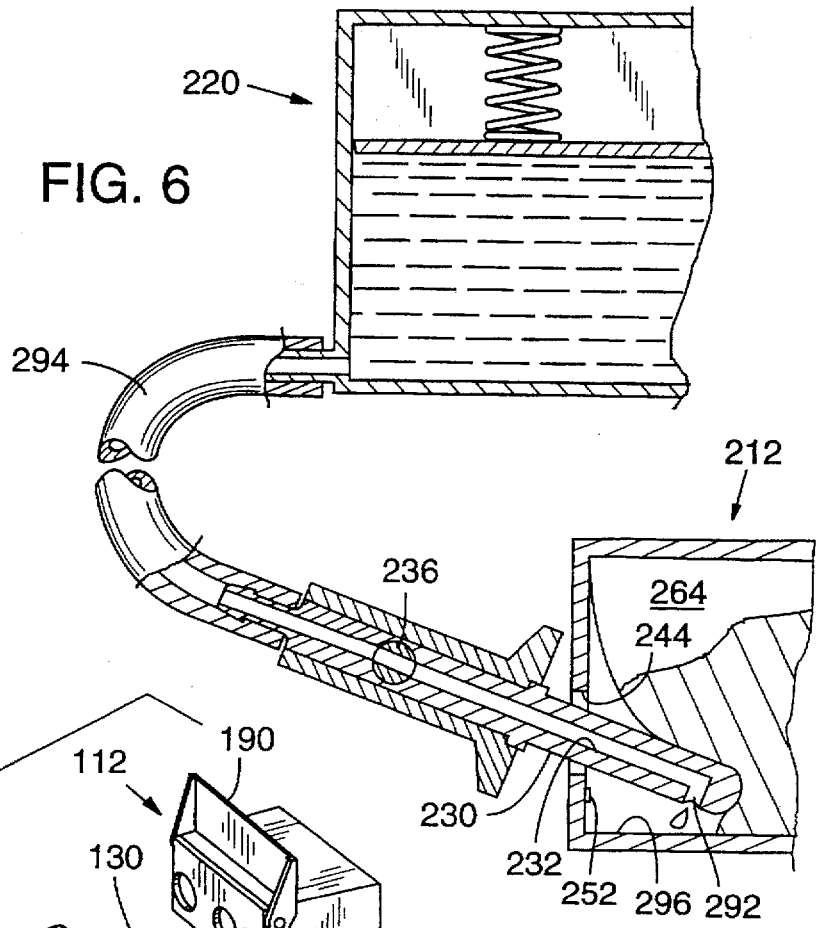
FIG. 6 is a cross-sectional side view of an alternative embodiment of the invention.

FIG. 6 shows a further alternative embodiment in which a nozzle 230 also serves as a foam compression element. In this embodiment, the reservoir 220 is fixed to the printer, and is connected to the nozzle 230 by a flexible tube 294. A valve 236 is contained within the nozzle, which is greatly elongated to probe deeply through aperture 244 to significantly compress foam 264. Outlet passage 232 does not exit the tip of the nozzle, but exits laterally through aperture 292 near the free end of the nozzle. This permits ink to flow readily without the significant resistance that might result from the highly compressed foam at the tip of the nozzle.

In this embodiment, the ink is emitted from the passage 232 onto a floor region 296 that is exposed when the foam is compressed. Ink is readily absorbed by the foam, until the foam is saturated, at which point the ink floods the floor region until the excess reaches the level of a pair of contacts 252, which are mounted within the pen 12 chamber below aperture 244, and spaced above the floor region 296.

The embodiments of FIG. 6 may employ a pump instead of the illustrated schematic spring-pressurized reservoir. Such a pump may be of the peristaltic type or employ a diaphragm, a bellows or a flexible impeller, all of which are positive displacing and self-priming. Positive displacement pumps prevent ink leakage from the nozzle, such as might ordinarily occur when the printer is not in use. For instance, during transport the printer may be oriented with the reservoir elevated relative to the nozzle. When not operating, a positive displacement pump blocks the conduit as if it were a closed valve, preventing leakage.

The self-priming feature is important because the printer may remain idle for long periods of time without printing, such as prior to purchase. A self-priming pump may be shipped unprimed.

The ink reservoir of the FIG. 6 embodiment need not be remote from the nozzle 230 as illustrated. The nozzle may be integral with or mechanically fixed to the reservoir.

Although the invention has been described in terms of several preferred and alternative embodiments, these embodiments may be modified without departing from the principles of the invention. For instance, the ink supply nozzle need not contact the screen or foam, but may be spaced apart from the foam to direct a stream of ink onto the foam. Alternatively, the ink may be poured onto the foam from above. The contact 52 need not be in the form of a pair of contacts for sensing resistance, but may include a single contact using capacitive, inductive, optical, or other means for detecting the presence of fluid. The reservoir 20 need not be continuously pressurized, but may be selectably pressurized only during refilling operations by mechanical interaction with other printer elements, or by a solenoid or other electrical actuator. Alternatively, a pump may be provided to serve both the pressurizing function and the valve function. The valve may be mechanically controlled, such as a spring-loaded normally-closed valve that is opened by interaction with the pen 12 or other printer elements during refilling operations. Alternatively, the valve may be actuated by a solenoid or other actuator controlled by the printer CPU.

In view of the many possible embodiments to which the principles of the invention may be put, it should be recognized that the detailed embodiments are illustrative only and should not be taken as limiting the scope of the invention. The invention is claimed including all such embodiments which may come within the scope and spirit of the following claims and equivalents thereto.

The invention claimed is:

1. An ink-jet printer comprising:

a pen housing including an enclosed chamber with chamber walls, the chamber walls including an inlet for receiving ink, an orifice for expelling droplets of ink and an aperture;

an ink retaining structure within the chamber;

an ink source having an ink reservoir;

a compression element located on the ink source and protruding therefrom, the compression element being aligned with the aperture in the pen housing for contacting the ink retaining structure, a movement of the compression element within the aperture serving to selectively reduce and expand the ink retaining structure;

an ink outlet distinct from the compression element connected to the ink source in communication with the ink reservoir, the ink outlet being selectively sized to engage with the pen inlet when the compression element moves within the aperture in the pen housing;

a sensor positioned adjacent the chamber for detecting a selected amount of ink in the chamber; and an ink flow control coupled to the sensor and to the ink outlet for controlling ink flow from the ink outlet.

2. The ink-jet printer of claim 1 wherein the pen housing is movable relative to the reservoir.

3. The ink-jet printer of claim 1 wherein the ink retaining structure comprises hydrophilic foam.

4. The ink-jet printer of claim 1 wherein the compression element comprises a rigid element connected to the ink source, and aligned with the aperture in the pen housing such that connection of the ink outlet and the pen inlet causes the compression element to compress the ink retaining structure.

5. The ink-jet printer of claim 1 wherein the sensor comprises at least one electrical contact for detecting moisture.

6. The ink-jet printer of claim 5 wherein the contact is mounted on the pen housing.

7. The ink-jet printer of claim 1 werein the sensor comprises a pair of electrical contacts defining a gap, and wherein the sensor is responsive to ink bridging the gap.

8. An ink jet printer comprising:

a pen housing including an enclosed chamber with chamber walls, the chamber walls including an inlet for receiving ink into the chamber, an orifice for expelling droplets of inks and an aperture;

an ink retaining structure housed within the chamber, the ink retaining structure occupying a volume of space;

an ink source having an ink reservoir:

a compression element located on the ink source and protruding therefrom, the compression element being aligned with the aperture in the pen housing for contacting the ink retaining structure, a movement of the compression element within the aperture serving to selectively vary the volume of the ink retaining structure; and the ink source also having an ink outlet which is distinct from the compression element and which is in fluid connection with the ink reservoir, the ink outlet being selectively sized to engage with the pen inlet when the compression element moves within the aperture in the pen housing.

* * * * *